United States Patent [19]

Leas

[11] Patent Number: 4,555,249

[45] Date of Patent: Nov. 26, 1985

[54] SOLID FUEL GASIFYING UNIT AND GAS FRACTIONATING UNIT

[76] Inventor: Arnold M. Leas, 122 N. 34th St., Richmond, Ind. 47374

[21] Appl. No.: 562,087

[22] Filed: Dec. 16, 1983

[51] Int. Cl.[4] ..... C10J 3/54; C10J 3/56

[52] U.S. Cl. ..... 48/62 R; 48/63; 48/77; 48/197 R; 48/202; 48/209; 252/373; 422/142; 422/227

[58] Field of Search ..... 48/197 R, 202, 206, 48/209, 210, 62 R, 76, 77, 63, 101, 111, 197 A, 61, 203; 422/142, 144, 146, 227, 230; 208/8 R, 10, 11 R; 252/373

[56] References Cited

U.S. PATENT DOCUMENTS

| | | | |
|---|---|---|---|
| 2,713,949 | 7/1955 | Stevenson | 414/217 |
| 2,753,061 | 7/1956 | Trainer | 414/786 |
| 2,761,575 | 9/1956 | Visconty | 414/786 |
| 2,812,244 | 11/1957 | Roetheli | 422/145 |
| 2,837,467 | 6/1958 | McClure | 208/173 |
| 2,897,063 | 7/1959 | Breier | 422/224 |
| 3,031,287 | 4/1962 | Benson et al. | 48/197 R |
| 3,222,147 | 12/1965 | Benson | 48/197 R |
| 3,223,616 | 12/1965 | Huntington | 208/89 |
| 3,421,869 | 1/1969 | Benson | 48/197 R |
| 3,454,383 | 7/1969 | Pirsh et al. | 48/101 |
| 3,619,142 | 11/1971 | Johnson et al. | 48/197 R |
| 3,801,288 | 4/1974 | Leas et al. | 48/197 R |
| 4,094,651 | 6/1978 | Donath | 48/210 |
| 4,205,196 | 5/1980 | Makovec et al. | 585/701 |
| 4,274,839 | 6/1981 | Leas | 48/202 |
| 4,318,711 | 3/1982 | Smith | 48/197 R |
| 4,343,624 | 8/1982 | Belke et al. | 422/142 |

*Primary Examiner*—Peter Kratz
*Assistant Examiner*—Joye L. Woodard
*Attorney, Agent, or Firm*—John J. Byrne; Bradford E. Kile; Jameson Lee

[57] ABSTRACT

A solid fuel gasifying unit is used to convert coal and other combustible organic solids to gaseous end products. Solid feed enters the vertical preheat zone of S-shaped gasifying unit and is mixed with a hot recycle reagent such as clay. The solid material fills the preheating zone of the unit to an elevation sufficient to create a gravitational particle flow which forces the solid particles in the lower end of the zone into the bottom of a vertical gasifying zone and through the remaining sections of the unit. In the gasifying zone, a fluidizing gaseous stream such as carbon dioxide or steam is injected to enhance the flow of the solid particles.

Also disclosed is a gas fractionating unit and a relatively high pressure solid fuel gasifying unit which contain a reagent powder having a significant weight difference in reduced form as compared with the weight of the powder in oxidized form and which may be circulated through the unit under gravity flow during oxidation-reduction chemical processing. The gas fractionating unit may be used in combination with either gasifying unit, and each unit provides an efficient means to circulate solid particles.

12 Claims, 3 Drawing Figures

16
20
18
14
12
30
28
22
10
70
72
74
76
78
82
80
81
64
62
60
66
40
38
50
42
48
58
32
52
37
46
51
24
36
44
26
54
56
34
36

SOLID FUEL GASIFYING UNIT AND GAS FRACTIONATING UNIT

BACKGROUND OF THE INVENTION

This invention relates to improved chemical processing units and the processes which use these units. More particularly, this invention relates to a solid fuel gasifying unit and a gas fractionating unit which may be operated in sequence and/or with other chemical processing units, and which use a gravitational driving force to circulate solid material in a smooth and continuous fashion.

The threshold or common denominator of all commercial chemical reaction systems is that they must be economical to operate. In the prior art, solid fuel gasifying units have been cost-justified when designed to handle relatively high feed rates; that is, feed rates in excess of 500 tons per day. However, owners of small coal deposits or of other sources of solid fuel materials, such as lumber mills, often cannot justify the expense of constructing a solid fuel gasifying system due to the relatively small feed rates at which they would operate.

The construction of gasifying units handling relatively low feed rates has heretofore been unsatisfactory because the design of a unit to operate around a pressure of 200 psig, as is common in the industry, has required small diameter piping which made physical installation and inspection of the interior of the unit difficult, if not impossible. Thus, solid fuel owners who would otherwise wish to generate steam and other useful, gaseous products from coal or other solid fuel feedstocks have been unable to do so. Accordingly, it has been desirable to furnish at least a partial solution to this problem by providing an efficient gasifying process and unit which operates at a relatively low pressure, thereby allowing higher gas volume rates and piping of correspondingly larger diameter.

Another major problem faced by prior operators of solid particle circulating units, including solid fuel gasifying units and gas fractionating units, is the frequent instance of valve malfunction due to solids accumulation and abrasion. In solid fuel gasifying units which employ solid catalytic reagents, the valves which surround the lock-bin screw conveyor in the feed line and which regulate the flow of reagent through the system are particularly prone to failure. In gas fractionating units, the valves which direct the flow of the circulating reagent powder in the fractionating zones are particularly troublesome. Solids accumulation in or near these valves can make them difficult to open, close, and control, and can significantly affect the performance of the unit. If sufficiently serious, valve malfunction may force a costly unit shutdown for repair or replacement.

The problems suggested in the preceding are not intended to be exhaustive, but rather are among many which tend to reduce the effectiveness of prior solid fuel gasifying systems and gas fractionating systems. Other noteworthy problems may also exist, however, those presented above should be sufficient to demonstrate that such units appearing in the prior art have not been altogether satisfactory.

OBJECTS AND SUMMARY OF THE INVENTION

It is a general object of the invention to provide a solid fuel gasifying unit and a gas fractionating unit which will obviate or minimize problems of the type previously described.

It is a particular object of the invention to provide a relatively low pressure, solid fuel gasifying unit which operates efficiently at low feed rates.

It is another object of the invention to provide a relatively low pressure, solid fuel gasifying unit which does not require a lock-bin screw conveyor fuel system or fuel systems with complex valve arrangements.

It is yet another object of the invention to provide a process for gasifying solid fuel that operates continuously at a relatively low pressure.

It is still another object of the invention to provide a process for recovering hot reaction gases from a relatively low pressure, solid fuel gasifying unit as a heat source for steam generation and for further chemical processing.

It is yet still another object of the invention to provide a gas fractionating unit which circulates metal reagent powder and which avoids the need for complex valve arrangements.

It is a further object of the invention to provide a process for recovering a relatively pure hydrogen stream from a gas fractionating unit by contacting an alloyed iron powder with reducing and oxidizing gases wherein the reagent powder is efficiently and continuously circulated within the unit.

It is yet another object of the invention to provide a solid fuel gasifying unit which operates at a relatively high pressure and efficiently circulates a solid reagent within the gasifying zone and which avoids the need for complex valve arrangements.

It is still a further object of the invention to provide a process for recovering gases for use in steam generation and further chemical processing from a solid fuel gasifying unit operating at a relatively high pressure which circulates solid reagent within the gasifying zone without complex valve arrangements.

It is yet still a further object of the invention to provide a solid fuel gasifying unit in combination with a gas fractionating unit in order to produce a relatively pure gaseous stream such as hydrogen.

It is another object of the invention to provide a process for recovering a relatively pure gaseous stream from a solid fuel feedstock by combining a solid fuel gasifying unit with a gas fractionating unit.

BRIEF SUMMARY OF THE INVENTION

One preferred embodiment of the invention which is intended to accomplish at least some of the foregoing objects resides in an apparatus for gasifying a solid combustible fuel comprising:

a vertical preheating zone having inlet means near an upper end of the zone and outlet means near a lower end of the zone, wherein a solid fuel feed may be transferred through said inlet means in admixture with hot solid recycle reagent to preheat the feed and to form a relatively dense bed of solid feed and recycle reagent particles which extends vertically within the preheating zone to an elevation sufficient to create a gravitational particle flow which forces the solid particles in the lower end of the bed into a gasifying zone and through the remaining path of particle flow of the gasifying unit;

a vertical gasifying zone having solid fuel inlet means located near the lower end of said gasifying zone and connected to said outlet means of said preheating zone so that said solid fuel and reagent can flow by gravity directly from said preheating zone to said gasifying zone, and having a first fluidizing gas inlet means positioned below said solid fuel inlet means so that upon entry of a gasifying medium into the gasifying zone, said solid fuel and reagent in said zone are fluidized and directed to the upper end of the gasifying zone;

a gas-solid separator positioned near the top of said gasifying zone to permit hot reaction gases to exit through the separation means and to direct ash product, reagent, and ungasified solid feed particles to an upper end of a vertical cooling zone;

a vertical cooling zone having solid particle inlet means through which the solids from said gasifying zone may be received to form a hot, downward-flowing bed, and having a cooling gas inlet means positioned near a bottom portion of the cooling zone through which relatively cool gases enter and reduce the temperature of said solid particle bed and complete the gasifying reaction of the solid fuel; and a vertical ash separation zone positioned annularly around a lower portion of said cooling zone to receive solid particles exiting the cooling zone, and having a first outlet means directed to an ash recovery zone and a second outlet means located at a lower elevation than said first outlet means and directed to a reagent recycle zone, and a second fluidizing gas inlet means positioned near the bottom of said zone so that upon entry of a fluidizing gas said solid particles are fluidized and pass through the annular space around said cooling zone and said lighter ash particles are directed to said ash recovery zone and said heavier reagent particles are directed to said reagent recycle zone.

Another preferred embodiment of the present invention resides in a process for gasifying solid fuel comprising the steps of:

passing a solid feed fuel in admixture with hot recycle reagent into an upper portion of a vertical preheating zone wherein the feed is heated and forms with the reagent a continuous bed of solid particles extending vertically within the preheating zone to an elevation sufficient to create a gravitational particle flow of the solid particles in the bed into a gasifying zone and through the remaining path of solid flow of the gasifying unit;

directing said flowing solid particles in said preheating zone to a lower end of a vertical gasifying zone, and introducing a first fluidizing gas into said gasifying zone at a point below the location of the solid particle inlet so that said particles are fluidized and directed through the gasifying zone to the upper end of the zone;

contacting the gas and solid mixture from said gasifying zone with a gas-solid separator positioned near a top portion of said gasifying zone to permit the hot reaction gases to exit the zone through the separation means and to direct the ash product, the reagent, and the ungasified solid feed particles to the upper end of a vertical cooling zone;

introducing a relatively cool gas stream into a lower end of said vertical cooling zone to reduce the temperature of the solid particles in said zone and to complete the gasifying reaction; and passing the solid particles from said cooling zone to a vertical ash-reagent separation zone positioned around the lower portion of said cooling zone and separating the lighter ash particles from the heavier reagent particles by fluidizing the solids with a second fluidizing gas stream introduced near the bottom of the separation zone, whereby the lighter ash particles are carried to a first outlet means extending from the separation zone and the heavier reagent particles directed to a second outlet means extending from the separation zone and positioned in the zone at a lower elevation than the first outlet means.

In another preferred embodiment of the invention, a gas fractionating unit comprises;

a fractionating vessel with at least two concentric vessel walls which define an inner space and an outer annular space and having a first bed of a reagent powder located in the inner space and second bed of said reagent powder located in an outer annular space, said reagent powder containing a metal alloy which exhibits a substantial weight variance depending upon whether the alloy is in reduced form or in oxidized form;

reagent circulating ports located near the upper and lower ends of said inner space said upper ports being positioned in contact with an upper portion of each reagent bed so that when reagent is introduced through said lower ports, a corresponding portion of reagent is released through said upper ports to provide an uninterrupted flow of solids circulation between said inner and outer spaces;

a first gas inlet means for introducing a first gas stream to said inner space wherein said stream is contacted with said first bed of reagent powder, said first gas stream selected to react with the reagent powder to form either a primarily reduced or a primarily oxidized reagent bed;

a first gas exit means through which reaction product gas may exit said inner space; and a second gas inlet means for introducing a second gas stream to said outer space wherein said stream is contacted with said second bed of reagent powder, said second gas stream having components which react with said second bed of reagent powder to form a bed of powder having a weight which is sufficiently different from the weight of said first bed of reagent powder to cause a gravitational flow of reagent powder from the heavier bed throgh the lower circulating ports and to the lighter bed thereby inducing reagent circulation between the inner and outer bed.

Another preferred embodiment of the invention entails a process for fractionating a gas stream which comprises:

introducing a first gas stream into a fractionating vessel with at least two concentric vessel walls which define an inner space and an outer annular space and having a first bed of reagent powder located in the inner space and a second bed of reagent powder located in the outer annular space, said reagent powder containing a metal alloy which exhibits a substantial weight variance depending upon whether the alloy is in reduced form or in oxidized form, and having reagent circulating ports located near the lower end of said inner space and near the upper end of said inner space, said upper ports positioned in contact with the upper portions of each reagent bed so that when reagent is introduced through said lower ports, a corresponding portion of reagent is released through said upper ports to provide an uninterrupted flow of solids between said inner and outer spaces, said first gas stream being directed to said inner space wherein it is contacted with said first bed of reagent particles;

reacting at least some of said first gas stream with the reagent powder to produce a primarily reduced, or a primarily oxidized reagent bed;

removing the reaction gases from said inner space;

introducing a second gas stream into said outer annular space and into contact with said second bed of reagent powder, said second gas stream having components which react with said second bed of reagent powder and which form a bed of powder having a weight which is different from the weight of said first bed of powder; and passing a portion of the heavier bed by gravity flow through the circulating ports between the beds and into the bottom of the lighter bed to induce circulation of reagent between the beds.

In a further preferred embodiment of the invention a vertical solid fuel gasifying unit comprises:

a solid fuel feed inlet means positioned in a lower section of said unit and beneath a fuel gasifying zone;

gasifying and fluidizing gas inlet means positioned beneath said feed inlet means whereby upon introduction of fluidizing gas to the unit, said solid feed is directed upward to the gasifying zone;

a gasifying zone positioned above said solid fuel feed inlet and containing hot circulating solid reagent, said reagent having impregnated on it a metal alloy which is heavier in reduced form than in oxidized form, wherein said fluidized solid fuel feed is contacted with said solid reagent and gasified to produce a reaction gas containing reducing components which further react with said reagent powder to reduce said alloy on said reagent powder, thereby increasing the weight of said reagent powder and causing said reagent powder to gravitate downward through the reagent bed;

a gas-solid separator positioned above said gasifying zone to permit hot reaction gases to exit the zone and to block the passage of any solid particles;

an ash accumulator positioned below said gas-solid separator and above said gasifying zone to recover the relatively light solid ash produced in the gasifying zone;

solid reagent lower circulation ports positioned near the lower end of said reagent bed through which solid reagent may be passed to an oxidation zone;

an outer annular oxidation zone positioned to receive said reduced reagent from said lower circulation ports;

fluidizing and oxidizing gas inlet means positioned near the bottom of said oxidation zone whereby fluidizing and oxidizing gas is introduced to the oxidation zone to oxidize the reduced reagent and to direct the reagent to the top of the oxidation zone; and upper circulation ports positioned near the top of the oxidation zone and near the top of the gasifying zone to circulate the oxidized reagent to the top of the reagent bed in the gasifying zone in oxidized form.

Still another preferred embodiment of the invention comprises a process for gasifying solid fuels including the steps of:

passing a solid fuel feed into a vertical gasifying unit in a lower section of said unit and beneath a gasifying zone;

introducing a gasifying and fluidizing gas stream at a point beneath said feed to fluidize said feed and to direct said feed upward into said gasifying zone;

gasifying said fluidized feed in said gasifying zone to produce hot reducing gases by contacting said feed with hot solid circulating reagent powder, said reagent powder comprising a metal alloy which is heavier in reduced form than in oxidized form;

reacting said reagent powder with said reducing gases in said gasifying zone to form a heavier reduced reagent powder which gravitates downward through the reagent bed;

passing said reduced reagent powder through lower circulation ports positioned near the lower end of the reagent bed and into an outer annular oxidizing zone;

contacting said reduced reagent powder with a fluidizing and oxidizing gas introduced into the oxidizing zone near the bottom of said zone to fluidize said reagent and to oxidize said reagent to produce a lighter reagent powder which is carried to the upper end of the oxidizing zone; and passing said oxidized reagent through circulation ports positioned near the upper end of said oxidizing zone to the upper end of the reagent bed in the gasifying zone.

Other preferred embodiments of the present invention include the combination of a solid fuel gasification unit with a gas fractionating unit to produce a relatively pure high quality gas stream from a solid fuel feedstock, wherein in each unit solid particles are circulated by gravity flow. A process for recovering a high quality gas stream from a solid fuel feed by selectively combining the units described above is also included in the present invention.

Other objects and embodiments of the present invention will be apparent from the following detailed description.

DETAILED DESCRIPTION

Figure 1:
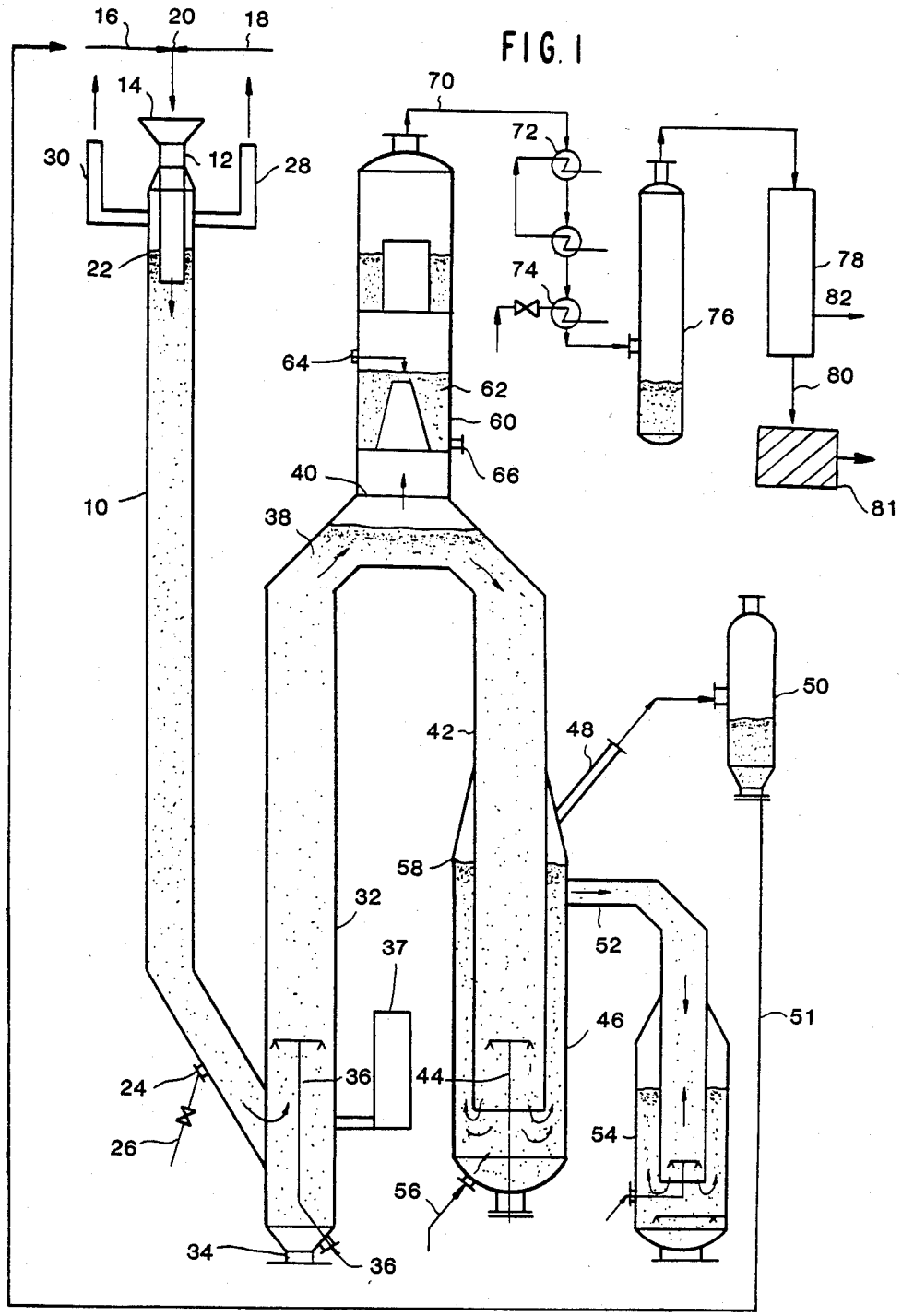
FIG. 1 is a schematic drawing of a low pressure gravity flow solid fuel gasifying unit in accordance with a preferred embodiment of the invention including a downstream gas fractionating unit.

Solid fuel gasifying units and gas fractionating units are used in several processes to produce energy and high quality gas streams. Steam energy is commonly produced by passing the hot off-gases from these units through a steam generation zone. Also, high grade gaseous streams may be recovered from processes associated with these units to be used directly as fuel or to be sent downstream for further chemical treatment.

The processing units involved in the present invention each involve contacting an inlet feed stream with a hot, circulating, solid reagent. In a solid fuel gasification unit, feed is in pulverized form and may be any combination of combustible organic materials such as coal, wood, tar sand, shale oil, and municipal, agricultural, or industrial waste. The choice of feed will typically depend upon resource availability and the type of reaction which the operator is seeking to promote. For example, a relatively pure hydrogen stream may be recovered by passing a mixed gas stream from a solid fuel gasifying unit to a gas fractionating zone containing a reducible metal reagent and, thereafter, oxidizing the reducing reagent with steam. If desired, ammonia may also be obtained from this process by adding nitrogen with the steam to the oxidizing zone.

The circulating reagent used in the solid fuel gasifying unit is preferably a 30-to-60 mesh clay, but may be any combination of magnesium silicate, attapulgus clay, bauxite clay, or sand. The circulating reagent in the solid fuel gasifying unit may serve several functions, including the acceleration of gasification reactions, elimination of tar oils formed by the gasification reaction, minimization of solid conglomeration and flyash production, and reduction of deleterious side reactions—such as methane production, if desired. When operating at relatively low pressure, the reagent may be metal-impregnated in concentrations of up to five percent by weight with a catalytic metal or metal alloy such as iron, chromium, nickel, cobalt, tungsten, or zinc. In the high pressure gasifying unit, the reagent should be impregnated with an iron alloy such as that used in the gas fractionating unit in order to ensure proper gravity flow circulation.

The circulating reagent in the gas fractionation unit will generally be a powdered metal alloy reagent, such as an iron powder alloyed with up to ten percent nickel or chromium. It is important for efficient circulation that the reagent powder exhibit a weight variance which is dependent upon whether the reagent is in reduced or oxidized form. For instance, iron powder alloyed with 10% chromium is a suitable reagent, as the weight of the powder in reduced form is approximately 80 percent greater than the weight of the powder in oxidized form and can be used to induce solid circulation through gravity flow.

One of the more important considerations in operating units of the type described in the present invention is a smooth and continuous transfer of solids. With respect to a relatively low pressure solid fuel gasifying unit, further care must be taken to ensure that the flow of solid feed through the unit is maintained in an unimpeded fashion. The present invention provides for the smooth, continuous solid flow through the units and avoids restrictive and expensive valve arrangements which can fail due to solids accumulation. In the operation of the low pressure solid fuel gasifying unit, the present invention provides still other advantages by avoiding the necessity of a costly lock-bin screw conveyor feed assembly.

The preferred embodiment of the present invention will now be described with reference to the drawings, wherein like numbers refer to like parts.

Referring now to FIG. 1, a schematic drawing of a relatively low pressure solid fuel gasifying unit operated in accordance with the present invention can be seen. The first leg of the S-shaped gasifying unit comprises a vertical preheat zone 10 having inlet means 12 shown in the drawing as elevated feed funnel 14. The solid fuel feed on the conveyor 16 is introduced to the gasifying unit at a rate of between 50 and 500 tons-per-day and is mixed with the hot solid reagent on the conveyor 18 at point 20 and directed into the feed funnel 14. The ratio of reagent to solid feed may range from between 0.5:1 to 20:1 by weight, with a ratio of approximately three-to-one preferred when clay is used as the reagent and coal is used as the feed. The solid mixture falls by gravity through inlet means 12 into the preheat zone 10 to form a continuous solid bed of particles maintained at an elevation indicated at 22. The vertical solid bed creates a gravitational driving force which causes the solids in the bed to flow through the remainder of the gasifying unit. Although the optimum elevation of the solid bed will vary according to the selection of solid materials and the desired throughput, a minimum elevation of at least 80 feet will generally be required with an elevation of 100 feet preferred.

In the preheat zone the solid feed line is heated by contact with hot solid reagent to a temperature of about 300° to 500° F. depending on the volatility of the feed. As a further preheating procedure, hot inert gas may be injected through nozzle 24 in line 26, and as the mixed feed gravitates downward through preheat zone 10, the warm gases perculate countercurrently upward and finally exit via vent pipes 28 and 30. This further preheating procedure will generally not be required, since the reagent used in the present invention may be recycled to the preheat zone at a temperature of from 300° to 500° F. Accordingly, gas inlet line 26 is commonly used only during the plant startup to purge the unit in order to avoid explosion.

As stated above, the solid particles in the preheating zone flow by gravity through the zone and into the bottom of the gasifying zone 32. There the particles are contacted with fluidizing and gasifying stream entering through lines 34 and 36 respectively. Air is generally used as the primary gasifying agent and enters through line 36, with steam being injected through line 34 to promote fluidization and to prevent excessive combustion temperatures. Although not shown in the drawing, carbon dioxide could also be used in place of steam or in combustion with steam for this purpose. The pressure near the bottom of the gasifying stream must be at least 50 psig, and is preferably at least 65 psig, to ensure that sufficient suction pressure will be available for downstream compressors. Connected to gasifying zone 32 is a pressure control unit 37 for maintaining and regulating pressure.

The gravitational driving force created by the solid bed in the preheat zone 10 acts in combination with the fluidizing gas entering at point 36 to carry the solid particles through the gasifying zone in contact with the gasifying stream. To promote fluidization, the fluidizing gas should enter the gasifying zone at a velocity of from two ft./sec. to eight ft./sec., with five ft./sec. preferred. The solids level in the gasifying zone, indicated at 38, should be at an elevation of at least 60 feet and preferably 70 feet, to ensure a sufficiently strong flow from the preheat zone and to provide for gravitational flow through the remainder of the unit.

The gaseous products from the gasifying zone exit the zone through a gas-solid separator 40, which may be a small mesh grating or other means to prevent the entrance of solid particles. The solids which at this point comprise reagent, ash, and unreacted solid fuel are directed to an endothermic cooling zone 42 where they are contacted by relatively cool gases entering the zone through line 44. About ninety percent of the solid fuel feed will be reacted in the gasifying zone, however nearly all of the remaining feed is gasified in the cooling zone to generate additional gases which exit through gas-solid separator. As shown in the drawing, the elevation of the solid bed at the upper end of the cooling zone is substantially the same as that in the gasifying zone, and these solids in the cooling zone flow under the force of gravity through the cooling zone and into the annular ash-reagent separation zone 46.

The separation zone 46 includes ash outlet means 48 in the annular space surrounding the lower portion of the cooling zone. Ash is transferred through outlet means 48 to an ash recovery vessel 50 where the ash is removed from the gasifying unit. Although not required, a portion of the ash recovered in vessel 50 may be recycled with the reagent stream to remove fine particulate matter from the gasifying unit. Separation zone 46 also includes reagent outlet means 52, located in the annular space surrounding the cooling zone but at an elevation below that of the ash outlet means 48. Outlet means 52 serves to direct the reagent to a reagent treatment and recycle zone 54. During operation of a separation zone, the gravitational driving force created by the solid bed in cooling zone 42 acts in combination with fluidizing gas injected through line 56 near the bottom of separation zone 46 to direct the solid ash and reagent upward through the separation zone. The ash is much lighter than the clay and is carried beyond the upper end of the solid bed 58 and into the ash outlet means 48 while the heavier reagent is passed into reagent outlet means 52. A portion of hot ash being let out is recycled via ash recovery vessel 50 and line 51 back to the solid feed line 16.

The reaction gases exit the gasification unit through gas-solid separator 40 at a temperature of up to 1800° F. and are directed to hot treater 60. The hot treater contains a solid reactant bed 62 containing reactive compounds such as calcium carbonate to remove sulfur compounds such as hydrogen sulfide from the outgoing gas stream. Fresh reactant may be continually added to the hot treater 60 through line 64, while spent reactant may be removed by line 66. Additional gas treatment may also be performed on the reactant gases before gases exit the hot treater 60 through line 70.

The still-hot reactant gases are directed from the hot treater 60 to a downstream steam generator 72, which may be of conventional design. A portion of the stream produced may be recycled to the gasification zone while the major portion of the steam is available for such use as production of electricity, heating, and chemical processing.

The reaction gases from generator 72 may be further used in downstream processing, as in a gas fractionating unit such as indicated at 78. These gases are commonly initially passed from the generator to a condensing unit 74 and to a water separation zone 76 in order to remove the water vapor from the gas stream. The dried gas stream, now containing, for example, primarily nitrogen, hydrogen, carbon monoxide, and carbon dioxide, may then be directed to a gas fractionating unit 78 where a high quality gas stream may be recovered through line 80 which is connected to a down stream processing unit 81 which recovers gas for use as starting material in further chemical processing. Other reactant gas products may be recovered through line 82 for further steam generation, for use as a recycle gas, or for use as starting materials for downstream processing.

The gas fractionating unit 78 of the present invention is described in detail with reference to FIG. 2. The fractionating unit has at least two concentric vessel walls 80 and 82 which define an inner space 84 and an outer annular space 86. Preferably, the unit additionally comprises concentric vessel walls 88 and 90 which cooperate with walls 80 and 82 which define annular spaces 92 and 94 wherein gas may be circulated to control the temperature of the unit and to preheat the gaseous feed.

Inner space 84 and outer annular space 86 contain circulating beds of metal reagent powder, the upper levels of which are indicated at 96 and 98, respectively. The specific reagent powder used may vary according to the nature of the chemical processes occurring within the unit, and selection of a suitable reagent requires not only that the reagent be active in the presence of the gaseous streams employed, but also that the reagent be readily convertible to a reduced form and to an oxidized form having a sufficient weight differential to create a gravitational driving force between the solid beds.

Figure 2:
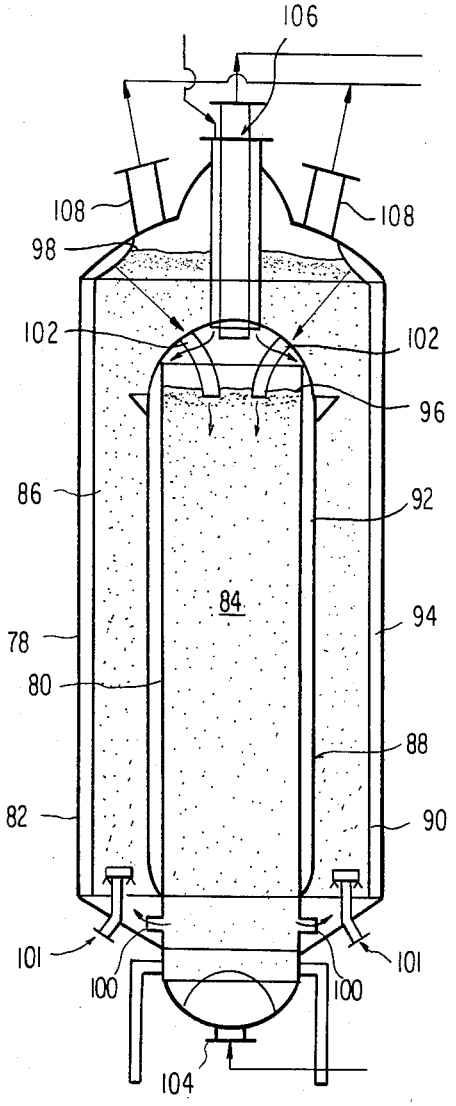
FIG. 2 is a schematic drawing of a gas fractionating unit in accordance with another preferred embodiment of the invention.

The unit described in FIG. 2 is intended to produce a relatively pure hydrogen stream through the oxidation and reduction of an alloyed iron powder which circulates between the oxidation zone and the reduction zone through circulation ports 100 and 102 located near the bottom and near the top of inner reduction zone 84. During oxidation of the reagent powder, the temperature at the top of oxidation zone 86 in the fractionating unit may be as high as 1800° F., and a metal alloy of iron—such as iron-nickel, or preferebly iron-chromium—should be used to avoid melting or plugging of the reagent. The use of an iron-alloy also maintains reagent in a powder form, which is a significantly more active form than, for example, a lump form. Reduction gas, which may comprise the dried reaction gases from a solid fuel gasifying unit, such as that exiting water separation zone 76 in FIG. 1, enter the fractionating unit 78 through inlet means 104 and are directed to the reduction zone defined by inner space 84. In this zone, the reagent powder is reduced and fuel compounds are combusted in accordance with the following reaction:

$$Fe_2O_3+CO+2H_2+N_2 \rightarrow 2H_2O+2Fe+CO_2+N_2$$

The gaseous products of reduction are recovered from the reduction zone through outlet means 106 and may be removed from the system to be used for steam generation, recycle gas, or for other purposes.

In the oxidation zone, defined by annular space 86, the reagent powder is oxidized with steam which enters the oxidation zone through line 101 to produce a relatively pure hydrogen stream in accordance with the oxidation reaction:

$$2Fe+3H_2O \rightarrow 3H_2+Fe_2O_3.$$

The hydrogen stream is removed from oxidation zone 86 through outlet means 108 and may be further treated for use in steam generation or chemical processing.

As the reagent powder in the reduction zone is converted from the oxidized to the reduced form, the weight of the powder increases to up to 80 percent greater than the weight in oxidized form depending on the particular alloy used. At the same time, the weight of the reagent powder in the oxidation zone decreases as the reagent powder is converted from reduced to oxidized form. The change in weight between the two reagent beds produces a gravitational driving force between the beds which is sufficient to cause the transfer of a portion of the reduced catalyst through the lower ports 100 in the inner space and into the annular oxidation zone. As a consequence, a corresponding portion of oxidized iron powder is transferred from the oxidation zone through upper ports 102 to the top of the reducing zone to be reduced and to continue the reaction and circulation process. If desired, the circulation of powder between the oxidation and reduction zones may be enhanced by increasing the velocity of the steam which enters the oxidizing zone to partially fluidize the reagent powder circulating to the upper end of the zone. In the preferred embodiment, sealing steam is also injected into upper and lower ports 100 and 102 at a rate sufficient to prevent the transfer of gases between the zones, but insufficient to interfere with the transfer of the reagent powder. If ammonia is a desired oxidation product, nitrogen may be added to the oxidation zone along with the inlet steam.

Figure 3:
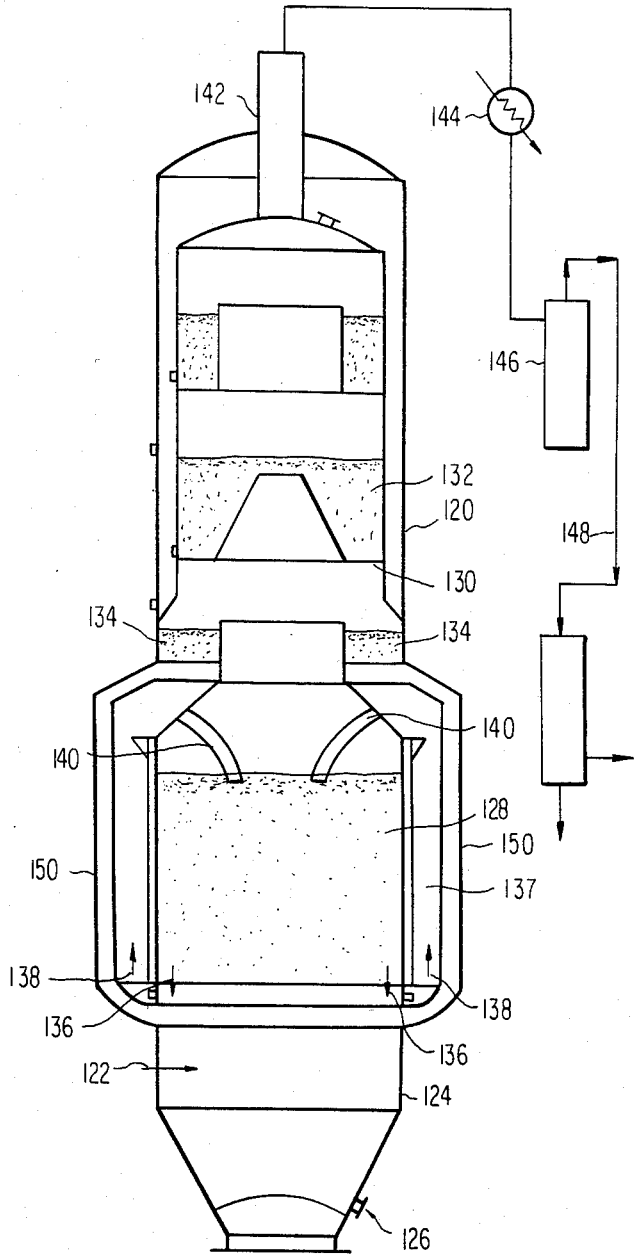
FIG. 3 is a schematic drawing of a relatively high pressure solid fuel gasifying unit in accordance with an embodiment of the present invention including a downstream gas fractionating unit.

As shown in FIG. 3, a solid fuel gasifying unit may also be operated in accordance with the present invention at a relatively high pressure of between 100 and 300 psig—preferably at about 200 psig—and capable of processing in excess of 500 tons-per-day of feedstock. Solid fuel may be introduced to gasifying unit 120 in any suitable fashion, for example, by means of a lock-bin screw conveyor, in fuel line 122. The feed is introduced in the lower section 124 of the gasifying unit where it is contacted with an air steam 126 which serves as the primary fluidizing and gasifying medium. The solid fuel is carried to the upper portion of the gasifying unit where it is contacted with a bed of circulating reagent in gasifying zone 128 and is gasified.

The reagent used in the high pressure gasifying unit is impregnated with a reducible metal alloy—such as an iron-chromium allow—and is circulated in a fashion similar to the solid circulation in the fractionating unit. The gasification of the solid fuel components produce gases such as hydrogen and carbon monoxide which reduce the metal alloy impregnated on the reagent and thereby increase the weight of the reagent. The heavier reagent flows downward in the circulating reagent bed in gasifying zone 128 and exits through lower circulating ports 136 to pass to oxidation zone 137. There the reagent is oxidized with air which enters the oxidation zone 137 through inlet means 138. Any residual carbon which has deposited on the clay is also gasified at this time and the heat produced by the oxidation and combustion reaction may be recovered by means of surrounding cooling jackets 150 to supply heat to the system. The lighter oxidized reagent is carried to the top of the oxidation zone and returned to the top of the circulating reagent bed in gasifying zone 128 through upper ports 140.

The reaction gases exit the gasifying zone through a gas-solid separator 130 and are directed to a hot treater 132 in a manner similar to that described with reference to the low pressure gasifying unit. The relatively light ash is carried upwardly from the reagent bed and is recovered in ash accumulation zone 134. The reaction gases exiting the hot treater 132 through outlet means 142 and may be passed to steam generator 144 and water separator 146 before passing through line 148 to the reduction zone of the fractionating unit described above.

In describing the above invention, reference has been made to particularly preferred embodiments. Those skilled in the art, however, and familiar with the disclosure of the subject invention, may recognize additions, deletions, substitutions, modifications, and/or other changes which will fall within the purview of the invention as defined in the following claims.

I claim:

1. An apparatus for gasifying solid combustible fuel comprising:

a vertical preheating zone having inlet means near an upper end of the zone and outlet means near a lower end of the zone wherein a solid fuel feed may be transferred through said inlet means in admixture with hot solid reagent to preheat the feed and to form a relatively dense bed of solid feed and reagent particles which extend vertically within the preheating zone to an elevation sufficient to create a gravitational particle flow which forces the solid particles in the lower end of the bed into a vertical gasifying zone;

said vertical gasifying zone having solid fuel inlet means located near a lower end of said gasifying zone and connected to said outlet means of said preheating zone so that said solid fuel and reagent can flow by gravity directly from said preheating zone to said gasifying zone, and having a fluidizing gas inlet means positioned below said solid fuel inlet means so that upon entry of a gasifying medium into the gasifying zone, said solid fuel and reagent in said zone are fluidized and directed to an upper end of the gasifying zone;

a gas-solid separator positioned near the upper end of said gasifying zone to permit hot reaction gases to exit through the separation means and to direct ash product, reagent, and ungasified solid feed particles to an upper end of a vertical cooling zone;

said vertical cooling zone having a solid particle inlet means through which solids from said gasifying zone may be received to form to a hot downward flowing bed, and having a cooling gas inlet means positioned near a bottom portion of the cooling zone through which relatively cool gases enter and reduce the temperature of said solid particle bed and complete the gasification reaction of the solid fuel; and a vertical ash separation zone positioned annularly around a lower portion of said cooling zone to receive the solid particles exiting the cooling zone and having a first outlet means directed to an ash recovery zone and a second outlet means located at a lower elevation than said first outlet means and directed to a reagent recycle zone and a fluidizing gas inlet means positioned near the bottom of said separation zone, so that upon entry of a fluidizing gas, said solid particles pass through the annular space around said cooling zone and said lighter ash particles are directed to said ash recovery zone and said heavier reagent particles are directed to said reagent recycle zone.

2. The apparatus as defined in claim 1 and further being characterized in that:

a neutralization zone positioned above said gas-solid separator to eliminate sulfurous compounds contained in the gases exiting through said separator.

3. The apparatus as defined in claim 1 and further comprising:

means for directing said hot gases produced in said gasifying zone to a steam generation unit.

4. The apparatus as defined in claim 3 and further comprising:

means for recovering said gases for use as starting materials in further chemical processing.

5. The apparatus as defined in claim 1 and further comprising:

means for recycling a portion of said hot ash to the vertical preheating zone.

6. The apparatus as defined in claim 1 and further comprising:

conveyor means for feeding said solid fuel to said preheat zone at a rate of from 50 to 500 tons-per-day.

7. The apparatus as defined in claim 1 and further being characterized in that the upper end of said vertical preheat zone is at least 80 feet in elevation, the upper end of said vertical gasifying zone is at least 60 feet in elevation, and the upper end of said cooling zone is at least 30 feet in elevation.

8. The apparatus as defined in claim 1 and further comprising:

means for maintaining the pressure at the bottom of said gasifying zone at at least 50 psig.

9. The apparatus as defined in claim 1 and further comprising a gas fractionating unit in combination with said gasifying zone to recover a high grade hydrogen stream.

10. A process for gasifying solid fuel comprising the steps of:

passing a solid fuel feed in admixture with hot reagent into the upper portion of a vertical preheating zone wherein the feed is heated and forms with the reagent a continuous bed of solid particles extending vertically within the preheating zone to an elevation sufficient to create a gravitational particle flow which forces the solid particles in the bed into a vertical gasifying zone;

directing said flowing solid particles in said preheating zone to the lower end of said vertical gasifying zone, and introducing a fluidizing gas into said gasifying zone at a point below the location of the solid particle inlet so that said particles are fluidized and directed through the gasifying zone to the upper end of the zone;

contacting the gas and solid mixture from said gasifying zone with a gas-solid separator positioned near the top of said gasifying zone to permit the hot reaction gases to exit the zone through the separation means and to direct the ash product, the reagent, and the ungasified solid feed particles to the upper end of a vertical cooling zone;

introducing a relatively cool gas stream into the lower end of said vertical cooling zone to reduce the temperature of the solid particle bed in said zone and to complete the gasification reaction, and passing the solid particles from said cooling zone to a vertical ash-reagent separation zone positioned around the lower portion of said cooling zone; and separating the lighter ash particles from the heavier reagent particles in said ash-reagent separation zone by fluidizing the solids with a fluidizing gas stream introduced near the bottom of the separation zone, whereby the lighter ash particles are carried to a first outlet means extending from the separation zone and the heavier reagent particles are carried to a second outlet means extending from the separation zone at a lower elevation than the first outlet means.

11. An apparatus for recovering a relatively pure gaseous stream from solid combustible fuel feedstock comprising:

a vertical preheating zone having inlet means near the upper end of the zone and outlet means near the lower end of the zone wherein a solid fuel feed may be transferred through said inlet means in a mixture with hot solid reagent to preheat the feed and to form a relatively dense bed of solid feed and reagent particles which extends vertically within the preheating zone to an elevation sufficient to create a gravitational particle flow which forces the solid particles in the lower end of the bed into a vertical gasifying zone;

said vertical gasifying zone having solid fuel inlet means located near the lower end of said gasifying zone and connected to said outlet means of said preheating zone so that said solid fuel and reagent can flow by gravity directly from said preheating zone to said gasifying zone, and having a fluidizing gas inlet means positioned below said solid fuel inlet means so that upon entry of a gasifying medium into the gasifying zone, said solid fuel and reagent in said zone are fluidized and directed to the upper end of the gasifying zone;

a gas-solid separator positioned near the upper end of said gasifying zone to permit hot reaction gases to exit through the separation means and to direct the ash product, the reagent, and the ungasified solid feed particles to an upper end of a vertical cooling zone;

said vertical cooling zone having a solid particle inlet means through which the solids from said gasifying zone may be received to form to a hot downward flowing bed, and having a cooling gas inlet means positioned near the bottom of the cooling zone through which relatively cool gases enter and reduce the temperature of said solid particle bed and complete the gasification reaction of the solid fuel; and a vertical ash separation zone positioned annularly around a lower portion of said cooling zone to receive the ash and reagent particles exiting the cooling zone and having a first outlet means directed to an ash recovery zone and a second outlet means located at a lower elevation than said first outlet means and a fluidizing gas inlet means positioned near the bottom of said separation zone so that upon entry of a fluidizing gas, said solid particles pass through the annular space around said cooling zone and said lighter ash particles are directed to said ash recovery zone and said heavier reagent particles are directed to a reagent recycle zone, a fractionating vessel for receiving said reaction gases from said gas-solid separator with at least two concentric vessel walls which define an inner space and an outer annular space and having a first bed of a reagent powder located in the inner space and second bed of said reagent powder located in the outer annular space, said reagent powder containing a metal alloy which exhibits a substantial weight variance depending upon whether the alloy is in reduced form or in oxidized form;

reagent circulating ports located near the upper and lower ends of said inner space, said upper ports positioned in contact with the upper section of each reagent bed so that when reagent is introduced through said lower ports, a corresponding portion of reagent is released through said upper ports to provide an uninterrupted flow of solids between said inner and outer spaces;

a first gas stream inlet means for introducing said gas from said gas-solid separator to said inner space wherein said stream is contacted with said first bed of reagent powder; said gas stream containing components which react with the reagent powder to form a primarily reduced reagent bed;

a gas exit means through which reaction product gas may exit said inner space; and a second gas inlet means for introducing a second gas stream to said outer space wherein said stream is contacted with said second bed of reagent powder, said second gas stream having components which oxidize said reagent powder to form a second bed of powder having a weight which is sufficiently different from the weight of the said first bed of reagent powder to cause a gravitational flow of reagent powder from the heavier bed through the lower circulating ports and to the lighter bed thereby inducing reagent circulation between the inner and outer bed.

12. An apparatus for recovering a relatively pure gaseous stream from a solid combustible fuel feedstock comprising:

solid fuel feed inlet means positioned beneath a fuel gasifying zone;

gasifying and fluidizing gas inlet means positioned beneath said feed inlet means whereby upon introduction of fluidizing gas to said gasifying zone, said solid feed is directed upward to the gasifying zone;

said gasifying zone positioned above said solid fuel feed inlet and containing a hot circulating solid reagent bed, the solid reagent contained therein having impregnated on it a metal alloy which is heavier in reduced form than in oxidized form, wherein said fluidized solid fuel feed is contacted with said solid reagent an gasified to produce a reaction gas containing reducing components which further react with said reagent to reduce said metal alloy on said reagent powder and causing said reagent powder to gravitate downward through the reagent bed;

a gas-solid separator positioned above said gasifying zone to permit hot reaction gases to exit the zone and to block the passage of any solid particles;

an ash accumulator positioned below said gas-solid separator and above said gasifying zone to recover the relatively light solid ash produced in the gasifying zone;

solid reagent lower circulation ports positioned near the lower end of said reagent bed through which solid reagent may be passed to an outer annular oxidation zone;

fluidizing and oxidizing gas inlet means positioned near the bottom of said oxidation zone whereby fluidizing and oxidizing gas is introduced to the oxidation zone to oxidize the reduced reagent and to direct the reagent to the top of the oxidation zone;

upper circulation ports positioned near the top of said oxidation zone through which oxidized reagent may be passed to the top of the reagent bed in the gasifying zone;

a fractionating vessel for receiving said reaction gases from said gas-solid separator with at least two concentric vessel walls which define an inner space and an outer annular space and having a first bed of a reagent powder located in the inner space and second bed of said reagent powder located in the outer annular space, said reagent powder containing a metal alloy which exhibits a substantial weight variance depending upon whether the alloy is in reduced form or in oxidized form; reagent circulating ports located near the upper and lower ends of said inner space, said upper ports positioned in contact with the upper section of each reagent bed so that when reagent is introduced through said lower ports, a corresponding portion of reagent is released through said upper ports to provide an uninterrupted flow of solids between said inner and outer spaces;

a first gas inlet means for introducing said gas from said gas solid separator to said inner space wherein said stream is contacted with said first bed of reagent powder, said first gas stream containing components which react with the reagent powder to form a primarily reduced reagent bed; a first gas exit means through which reaction product gas may exit said inner space; and a second gas inlet means for introducing a second gas stream to said outer space wherein said stream is contacted with said second bed of reagent powder, said second gas stream having components which oxidize said reagent powder to form a second bed of powder having a weight which is sufficiently different from the weight of the said first bed of reagent powder to cause a gravitational flow of reagent powder from the heavier bed through the lower circulating ports and to the lighter bed thereby inducing reagent circulation between the inner and outer bed.

* * * * *